US006272296B1

(12) United States Patent
Gartstein

(10) Patent No.: US 6,272,296 B1
(45) Date of Patent: Aug. 7, 2001

(54) METHOD AND APPARATUS USING TRAVELING WAVE POTENTIAL WAVEFORMS FOR SEPARATION OF OPPOSITE SIGN CHARGE PARTICLES

(75) Inventor: Yuri Gartstein, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/458,373

(22) Filed: Dec. 10, 1999

(51) Int. Cl.[7] ..... G03G 15/08
(52) U.S. Cl. ..... 399/55; 399/285
(58) Field of Search ..... 399/55, 281, 285, 399/289, 290, 291; 347/55

(56) References Cited

U.S. PATENT DOCUMENTS 4,647,179 3/1987 Schmidlin ..... 355/3 DD
5,512,981 * 4/1996 Hirsch ..... 399/257 X
6,070,036 * 5/2000 Thompson et al. ..... 399/266
6,112,044 * 5/2000 Thompson et al. ..... 399/285

* cited by examiner

*Primary Examiner*—Quana M. Grainger
(74) *Attorney, Agent, or Firm*—Lloyd F. Bean, II

(57) ABSTRACT

An apparatus for developing a latent image recorded on an imaging surface, including a donor member, spaced from the imaging surface, for transporting toner on the surface thereof to a region opposed from the imaging surface, the donor member includes an electrode array on the outer surface thereof, the array including a plurality of spaced apart electrodes extending substantial across width of the surface of the donor member; loading toner onto the donor member; a multi-phase voltage source operatively coupled to the electrode array, the multiphase voltage source generating a waveform which creates an electrodynamic wave pattern for moving toner particles of one polarity to and from a development zone and preventing toner particles of the opposite polarity from moving on to the development zone.

8 Claims, 11 Drawing Sheets

METHOD AND APPARATUS USING TRAVELING WAVE POTENTIAL WAVEFORMS FOR SEPARATION OF OPPOSITE SIGN CHARGE PARTICLES

FIELD OF THE INVENTION

This invention relates generally to a development apparatus for ionographic or electrophotographic imaging and printing apparatuses and machines, and more particularly is directed to a toner transport using traveling wave potential waveforms for separation of opposite sign charged particles, but can be also applied in other machines and technologies which involve handling and/or separation of small charged particles.

INCORPORATED BY REFERENCE

The following is specifically incorporated by reference patent application, D/98522, U.S. Ser. No., 09/312,873, D/98523, U.S. Ser. No. 09 1312,872 and D199724, U.S. Ser. No. 09/145,837 entitled "A MULTIZONE METHOD FOR XEROGRAPHIC POWDER DEVELOPMENT: VOLTAGE SIGNAL APPROACH", "A METHOD FOR LOADING DRY XEROGRAPHIC TONER ONTO A TRAVELING WAVE GRID"and "TONER TRANSPORT USING SUPERIMPOSED TRAVELING ELECTRIC POTENTIAL WAVES, respectively.

BACKGROUND OF THE INVENTION

Generally, the process of electrophotographic printing includes charging a photoconductive member to a substantially uniform potential so as to sensitize the surface thereof. The charged portion of the photoconductive surface is exposed to a light image from either a scanning laser beam or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image on image processing, superimposes toner powder images of different color toners onto the photoreceptor prior to the transfer of the composite toner powder image onto the substrate. While image on image process is beneficial, it has several problems. For example, when recharging the photoreceptor in preparation for creating another color toner powder image it is important to level the voltages between the previously toned and the untoned areas of the photoreceptor.

In the application of the toner to the latent electrostatic images contained on the charge-retentive surface, it is necessary to transport the toner from a developer housing to the surface. A limitation of conventional xerographic development systems, including both magnetic brush and single component, is the inability to deliver toner (i.e. charged pigment) to the latent images without creating large adhesive forces between the toner and the conveyor on which the toner rests and which transports the toner to latent images. As will be appreciated, large fluctuation in the adhesive forces that cause the pigment to tenaciously adhere to the carrier severely limits the sensitivity of the developer system thereby necessitating higher contrast voltages forming the images. Accordingly, it is desirable to reduce the large adhesion particularly in connection with latent images formed by contrasting voltages.

In order to minimize the adhesive forces, there is provided, in the preferred embodiment of the invention a toner conveyor including means for generating traveling electrostatic waves which can constantly move the toner about the surface of the conveyor with minimal static contact therewith.

Traveling waves have been employed for transporting toner particles in a development system, for example U.S. Pat. No. 4,647,179 to Schmidlin which is hereby incorporated by reference. In that patent, the traveling wave is generated by alternating voltages of three or more phases applied to a linear array of conductors placed abut the outer periphery of the conveyor. The force F for moving the toner about the conveyor is equal $qE_t$ where q is the charge on the toner and $E_t$ is the tangential field supplied by a multi-phase AC voltage applied to the array of conductors.

Traveling wave devices have been proposed for a number of years to transport, separate and deliver charged particles to a latent electrostatic image. Some of the other reasons this is an attractive approach include absence of moving mechanical parts, control of the toner position, long and stable development zones, and architectural flexibility. A semiconductive overcoat may be desirable on the grid providing a smooth surface for the toner motion and also a possible charge relaxation channel. It has been found that various modes of charged particle transport are possible. The so-called synchronous modes of the electrostatic traveling wave transport have been found and indicated as appropriate to facilitate the toner transport that can be used for xerographic development systems. In those modes, the toner particles move along the carrying surface with the traveling wave phase velocity $v_{ph}=\omega/k$ where $\omega$ and k are the frequency and the wavevector of the wave respectively. This velocity is achieved through the action of the longitudinal (x) component of the electrostatic force while the normal (z) component of the force on the average contains the toners near the carrying surface.

In the other, so-called "curtain" or asynchronous mode, toners would be effectively repelled by the wave from the surface and could be retained only by an external force such as the gravity or an applied electric field. In the absence of the latter, the toners would be very loose and subject to emissions. Transport in this mode ordinarily occurs with velocities much lower than $v_{ph}$.

SUMMARY OF THE INVENTION

There is provided an apparatus for developing a latent image recorded on an imaging surface, including a donor member, spaced from the imaging surface, for transporting toner on the surface thereof to a region opposed from the imaging surface, said donor member includes an electrode array on the outer surface thereof, said array including a plurality of spaced apart electrodes extending substantial across width of the surface of the donor member; loading toner onto said donor member; a multi-phase voltage source operatively coupled to said electrode array, said multiphase voltage source generating a waveform which creates an electrodynamic wave pattern for moving toner particles of one polarity to and from a development zone and preventing toner particles of the opposite polarity from moving on to said development zone.

An object of the present invention is to provide a novel class of electrostatic potential waveforms for traveling wave grids which will enable effective dynamic separation of charged particles of opposite signs as an additional functionality to their transport. This class comprises such waveforms that produce electrostatic potential reliefs with a special kind of either temporal or static asymmetry. With waveforms of the present invention, charged particles (e.g. toners) of opposite polarities are forced to exhibit very different dynamic responses, e.g., they can be transported in an unipolar synchronous mode (only species of one sign would be able to move with the wave phase velocity) or in an ambipolar bidirectional mode (particles of opposite signs move in opposite directions).

BRIEF DESCRIPTION OF THE DRAWINGS

FIG. 13 is a schematic elevational view of an illustrative electrophotographic printing or imaging machine or apparatus incorporating a development apparatus that can have the features of the present invention therein;

FIG. 14 is a schematic elevational view showing the development apparatus used in the FIG. 13 printing machine;

FIGS. 15 and 16 are top view of a portion of the flexible donor belt that can be used in the context of the present invention;

Inasmuch as the art of electrophotographic printing is well known, the various processing stations employed in the printing machine will be shown hereinafter schematically and their operation described briefly with reference thereto.

DETAILED DESCRIPTION OF THE INVENTION

Figure 13:
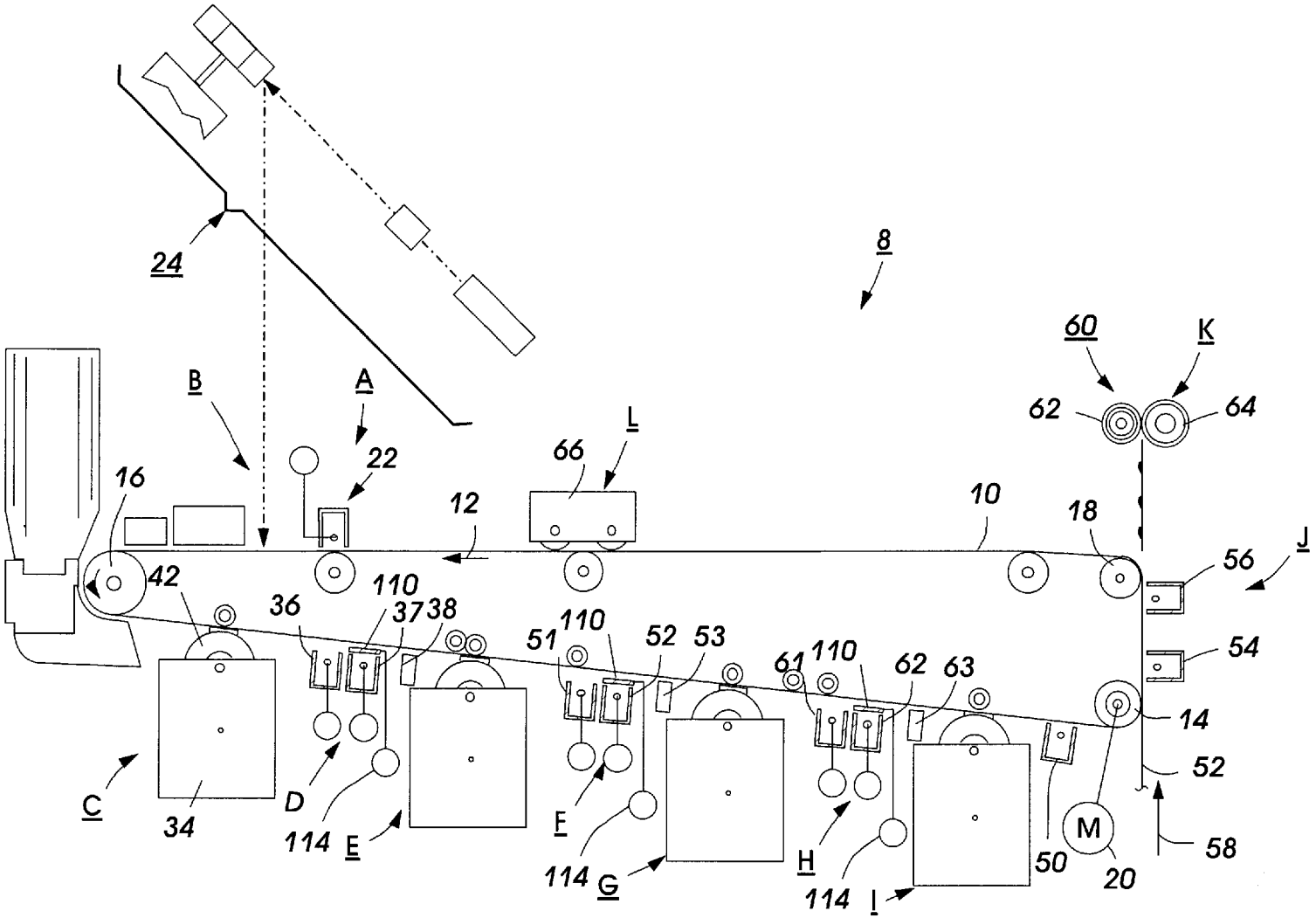
FIGS. 13—16 show illustrative printing and development apparatuses.

Referring initially to FIG. 13, there is shown an illustrative electrophotographic machine having incorporated therein the development apparatus of the present invention. An electrophotographic printing machine creates a color image in a single pass through the machine and incorporates the features of the present invention. The printing machine uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

As the photoreceptor belt 10 moves, the image area passes through a charging station A. At charging station A, a corona generating device, indicated generally by the reference numeral 22, charges the image area to a relatively high and substantially uniform potential.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention After passing through the first exposure station B, the now exposed image area passes through a first development station C which is identical in structure with development system E, G, and I. The first development station C deposits a first color, say black, of negatively charged toner 76 onto the image area. That toner is attracted to the less negative sections of the image area and repelled by the more negative sections. The result is a first toner powder image on the image area.

For the first development station C, development system 34 includes a flexible donor belt 42 having groups of electrode arrays near the surface of the belt which develops the image with toner.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

After being recharged by the first recharging device 36, the image area passes to the second recharging device 37.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B.

The image area then passes to a second development station E. Except for the fact that the second development station E contains a toner which is of a different color (yellow) than the toner (black) in the first development station C, the second development station is beneficially the same as the first development station. Since the toner is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Figure 14:
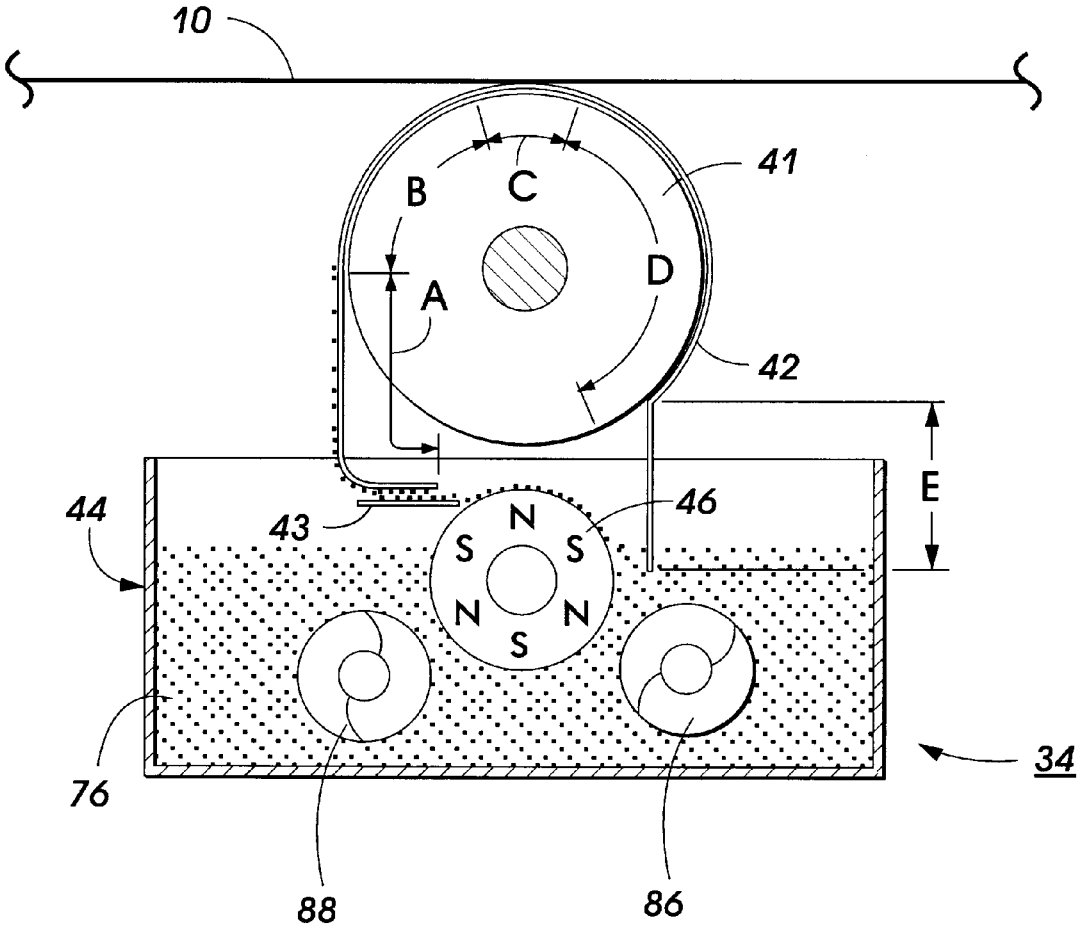
Figure 15:
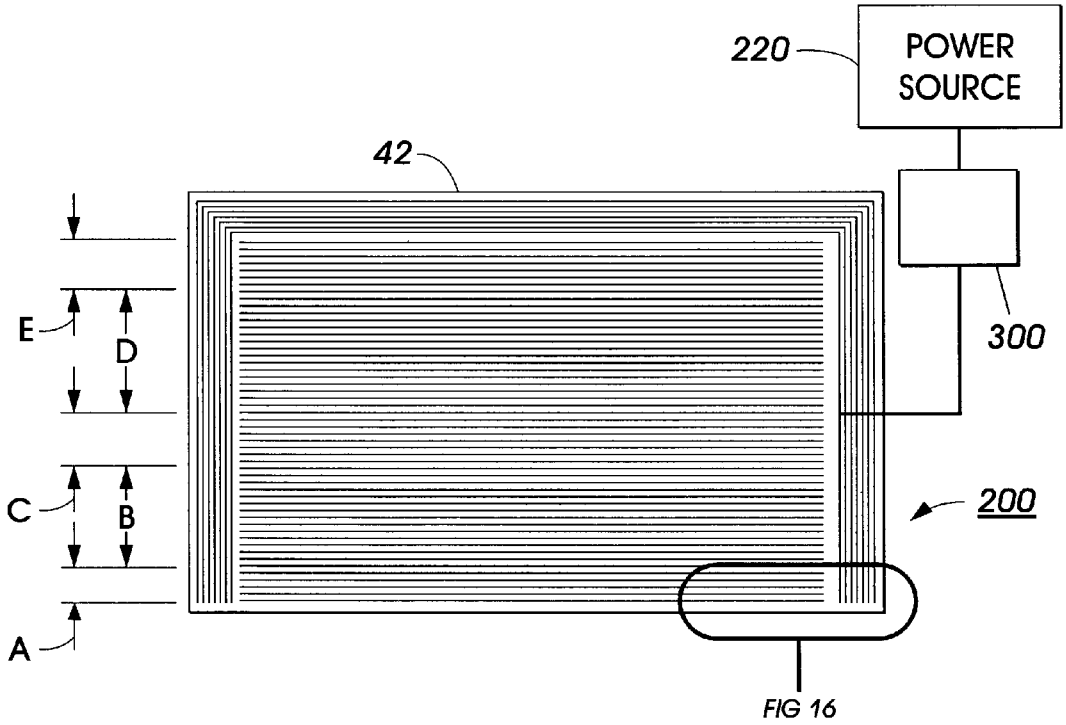
Figure 16:
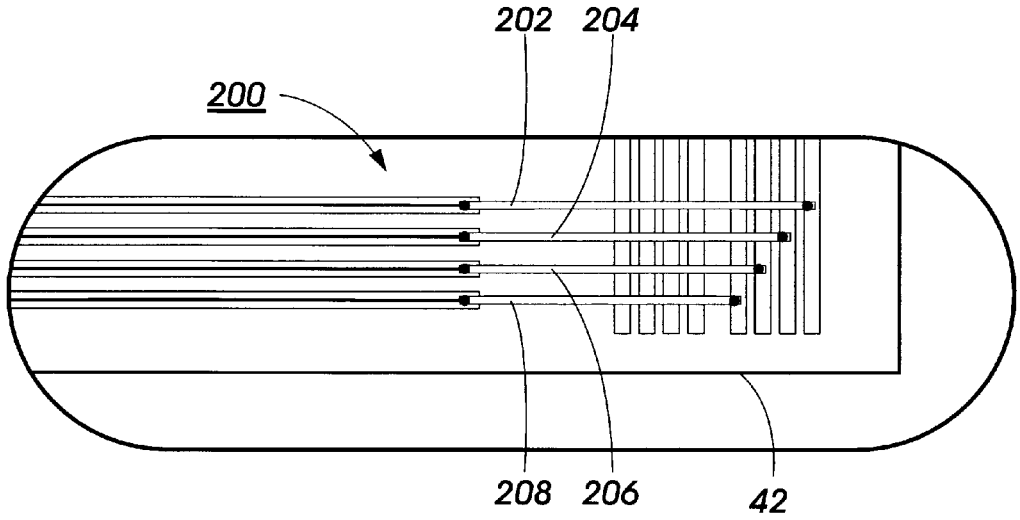

Turning to FIG. 14, which illustrates the development system 34 in greater detail, development system 34 includes a housing 44 defining a chamber 76 for storing a supply of developer material therein. Donor belt 42 is mounted on stationary roll 41 and belt portion 43 is mounted adjacent to magnetic roll 46. Donor belts 42 comprise a flexible circuit broad having finely spaced electrode array 200 thereon as shown in FIGS. 15 and 16. The typical spacing between electrodes is between 75 and 100 microns. The electrode array 200 has a four phase grid structure consisting of electrodes 202, 204, 206 and 208 having a voltage source and a wave generator 300 operatively connected thereto in the manner shown in order to supply the proper wave form in the appropriate electrode area groups A–E.

Electrode array 200 has group areas A–E in which each group area is individually addressable to perform the function of: (A) Loading toner onto the array from the housing; (B) Transferring toner to the development zone; (C) Developing the image in the development zone; (D) Transferring toner from the development zone and (E) Unloading toner from the array back into the housing. Each electrode array group area is independently addressable and operatively connected to voltage source 220 and wave generator 300. The electrodes in array group area (A) picks up the toner from the housing and transports it via the electrostatic wave set up by wave generator 300. Electrode array group areas A–E connected to the voltage source via wave generator 300 develops a traveling wave pattern is established. The electrostatic field forming the traveling wave pattern loads the toner particles from the developer sump 76 to the surface of the donor belt 42 and transports them along donor belt 42 to the development zone with the photoreceptor belt 10 where they are transferred to the latent electrostatic images on the belt 10. Thereafter, the remaining (untransferred) toner is moved by electrode array group area D to electrode group area E where remaining toner is unloaded off the belt.

An important property of this type of transporting device, especially in the context of electrode group areas A and B, is the ability to classify toners, e.g., by tribo, i.e. their charge-to-mass ratio, q/m. For instance, for given frequency and amplitude of the wave, only toners charged higher than some critical value would be able to move synchronously with the wave (to "catch the wave"). Correspondingly, very low-tribo toners would not be delivered into the development zone. However, for toner supplies containing both positively and negatively charged particles, it is another question that becomes very important, i.e. whether an effective separation of species can be achieved based solely on the sign of their charge (positive vs. negative) rather than on the magnitude of this charge or other particle parameters. From the very nature of the idealized (basic) sinusoidal traveling wave, it is clear that such a wave would like to transport particles of either sign in the same direction (that of the running wave itself, although separated by a half wavelength from each other. Indeed, the electrostatic force arising from a sinusoidal wave is given by its components $$F_x = qE_o \exp(-kz)\sin(\phi), \tag{1a}$$

$$F_z = qE_o \exp(-kz)\cos(\phi) \tag{1b}$$

where the phase $\phi = kx - \omega t$, $E_o$ the maximum field strength and q the particle charge. Evidently, the same distribution of the electrostatic forces would be seen by a particle of charge (−q) but positioned with respect to the wave with the phase shift $\pi: \phi \rightarrow \phi + \pi$. In other words, particles of opposite signs would ride opposite sides of the potential hill of the wave. The same considerations can apply for practical grid designs with finite number of phase electrodes, as is, e.g., sketched in FIG. 1 for a 4-phase grid design utilizing a conventional pulsed waveform.

Figure 1:
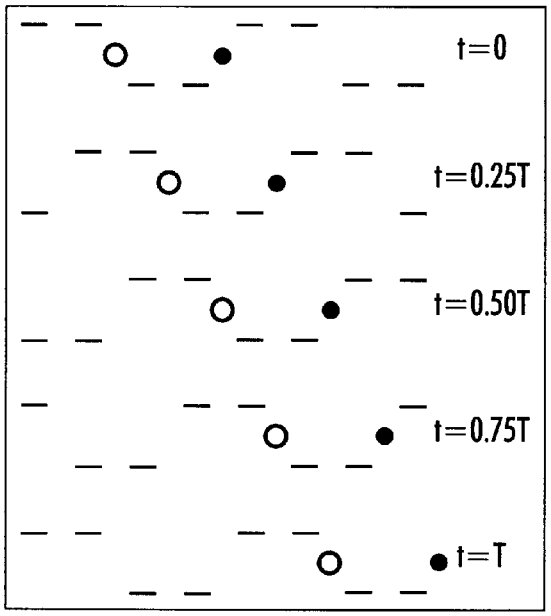
FIGS. 1–12 illustrate various driving waveforms and particle trajectories pertinent to the subject of the present invention and are described in more detail below.

FIG. 1. Schematically shown are potentials applied at different times of a conventional 50% duty cycle signal to electrodes of a 4-phase grid (displayed are 8 electrodes corresponding to two wavelengths of the structure). Circles symbolize positions of different charged particles right at the moment when the potential pattern indicated is switched on. Responding to a new distribution of electric fields, particles "move" to a new position shown at the next time step. Clear circle symbols are for positive particles and black circle ones are for negative. T is the period of the signal. We chose to schematically show the particles in between the electrodes (where the longitudinal forces are effective). The simplistic picture of synchronous transport displayed in FIG. 1 is corroborated by dynamical simulations as well as experimentally. Obviously, positive and negative particles here are transported in the same direction.

Figure 2:
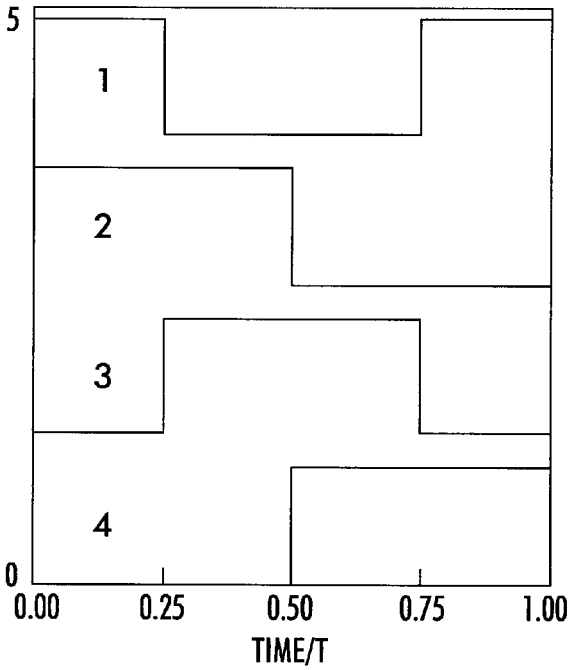

FIG. 2. The corresponding voltage pattern driving the electrodes of this grid during one period T For clarity, the voltage profiles for different electrodes are displaced vertically—the lower and upper values of the potential pattern are in fact the same for all electrodes.

The situation with practical grids employing various temporal waveforms is more complex than that with the idealized sinusoidal wave. An arbitrary potential waveform for an n-phase grid structure can be written as $$U(m\ x,t)=\Sigma_{i-1}^{n}\ g_i(t)f_i(X) \tag{2}$$

where $g_i$ and $f_i$ represent the temporal (periodic with period T) and spatial (periodic with period $\lambda$) contributions from the $\lambda$ electrode. The hardware grid design defines usually $f_i(x)=f(x-\lambda/n)$ where $\lambda$ is the structure wavelength—all electrodes are the same. It is the temporal waveform $g_i(t)$ that can be judiciously designed to achieve the separation purpose of the present invention. At each moment of time t, the potential relief (2) can be thought of as a periodically repeated potential hill structure. FIG. 1, e.g., gives a clear visualization of such a picture. The derivatives of the potential hill yield the fields acting on charged particles. Evidently opposite sides of the potential hill there are effectively responsible for a coherent interaction with oppositely charged particles respectively. The electrostatic picture of FIG. 1 possesses two important properties: firstly, the potential hill is symmetric with respect to a mirror reflection, and secondly, its time evolution corresponds essentially to translations along the wave propagation direction (preservation of shape). Whenever these two properties are in place (the latter, in general, with some accuracy caused by the discrete electrode structure), one should expect a similar transport pattern for both positive and negative charges. More precisely, dynamical simulations show that details of transport can sometimes differ for species of opposite signs but an overall average effect generally turns out to be the same.

To make synchronous transport for species of one sign prohibited, we propose to use waveforms that sufficiently strongly violate either of the two potential properties mentioned above. That is, e.g., the potential hill can be made strongly asymmetric statically, or, otherwise, its overall temporal evolution can be made more complex than a mere translation asymmetrically affecting potential hill's slopes. In what follows we give examples of such waveforms.

Figure 3:
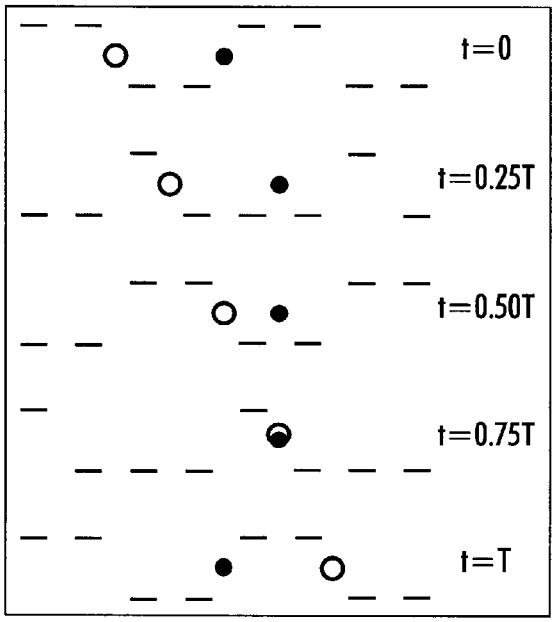
Figure 4:
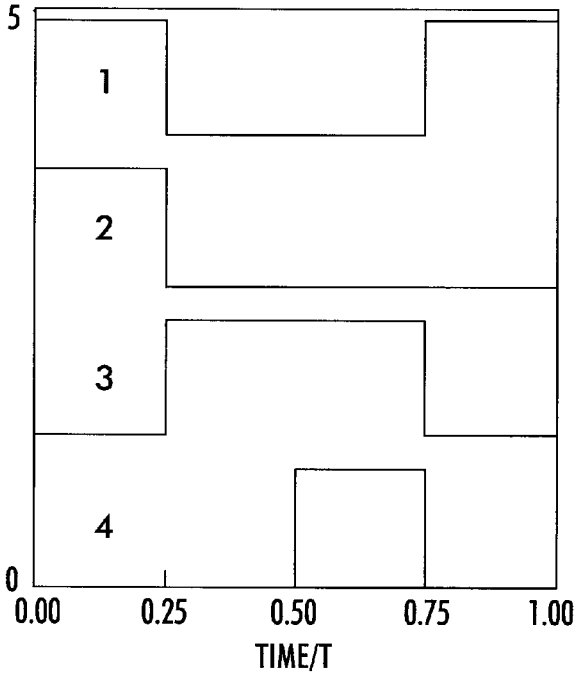

In the first example, illustrated in FIGS. 3 and 4, we temporally modulate the waveform in such a way that one side of the potential hill regularly translates with time (so that the particles riding this side can adjust their positions with respect to the wave) while the other side's relative position "fluctuates" (so that the particles that would otherwise ride this side have no time to adjust, fall "out-of-phase " and lose the wave; in practical conditions these particles would probably not load onto the grid at all.

FIG. 3. Using the same notation as FIG. 1, the potential patterns and their effect on charged particles are shown for the case where the waveform alternates between 50% and 25% duty cycle with the frequency twice as high as the main frequency.

FIG. 4. The corresponding voltage pattern driving the electrodes of this grid during one period T The same vertical displacement of voltage profiles for different electrodes as in FIG. 2.

As the simplistic picture of FIG. 3 suggests, the positive charges there are capable of synchronously moving with the wave while the negative charges cannot catch the wave (compare with FIG. 1). Dynamical simulations confirm this insight and show that the negative charges in this case are lifted from the carrying surface and could continue their transport but already only in the asynchronous curtain mode. The same method of waveform alternations works as well for 3-phase grids and other grid designs. As can be seen in FIG. 3, the potential drop used by the positive particle retains its relative position with respect to the wave, the negative charge, on the other hand, cannot see a "consistent" propelling force pattern.

In the second example, we use the facts that a modulated waveform can be made 'commensurable" with the wavelength and that opposite sides of the potential hill made act "coherently", to devise waveforms whose effects on particles of opposite signs would be even more "opposite ". The potential waveform shown in FIG. 5 differs from that in FIG. 3 by modified potentials of the electrodes at t=0.25T and t=0.75T so that momentarily the pattern looks as having the spatial period twice as small. The effect on transport turns out to be drastic: the species of opposite signs can now be transported in opposite directions.

Figure 5:
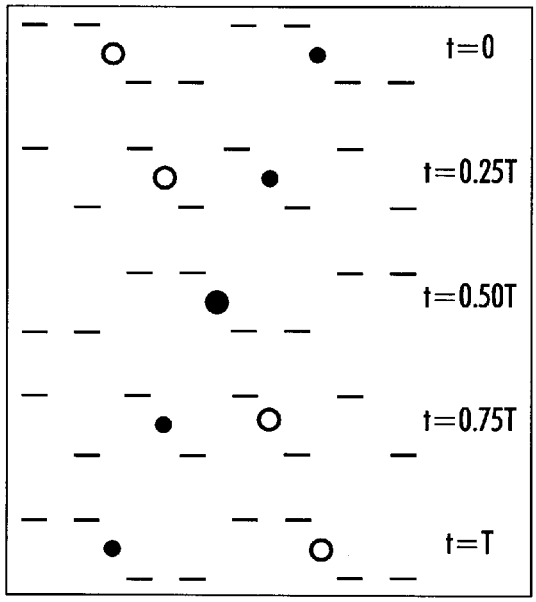

FIG. 5. Schematics of a modulated waveform that facilitates transport of opposite sign particles in opposite directions.

Figure 6:
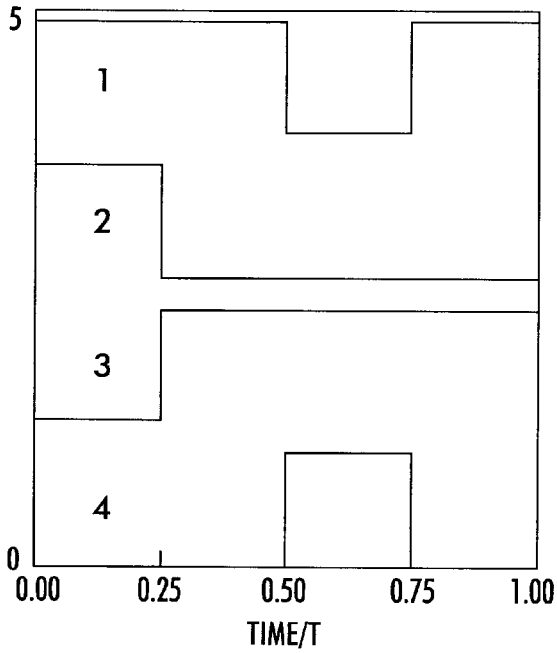
Figure 7A:
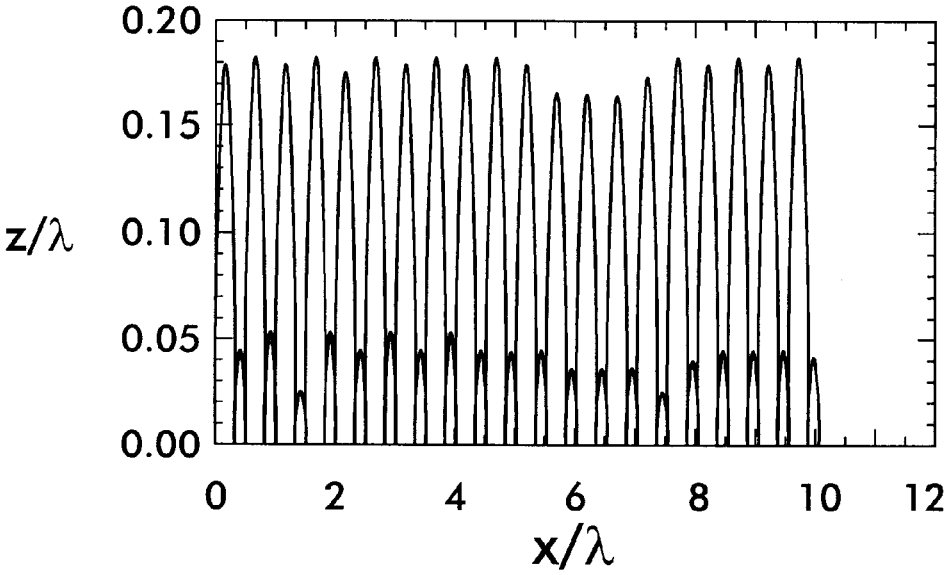
Figure 7B:
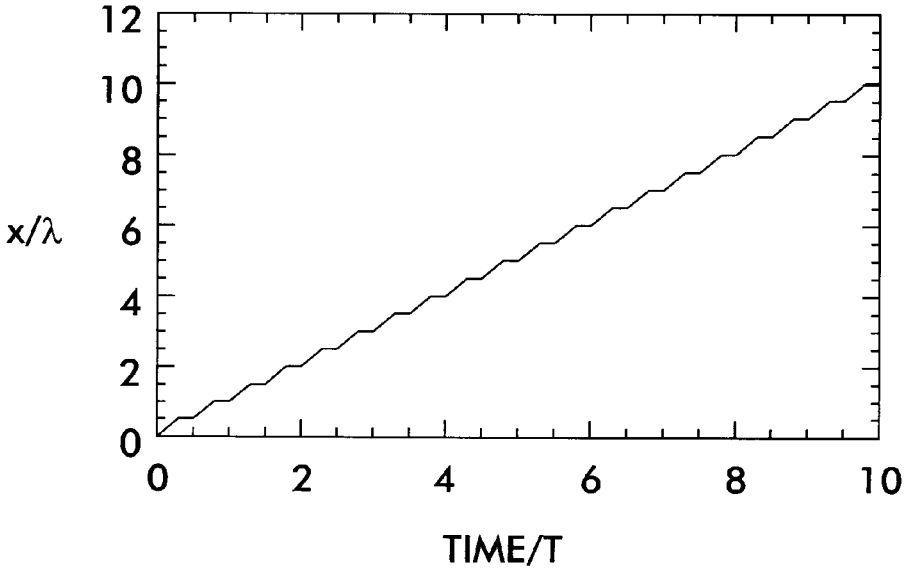
Figure 8A:
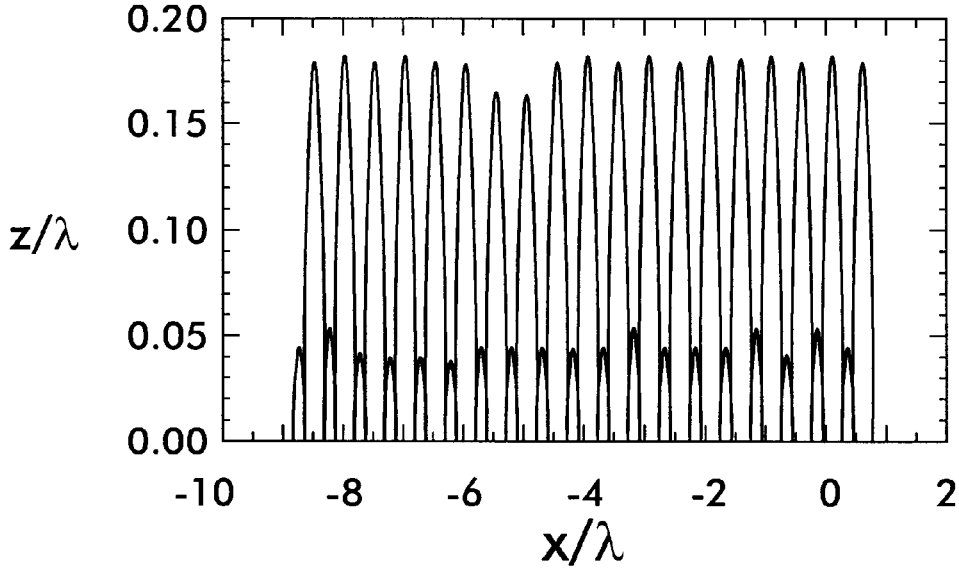
Figure 8B:
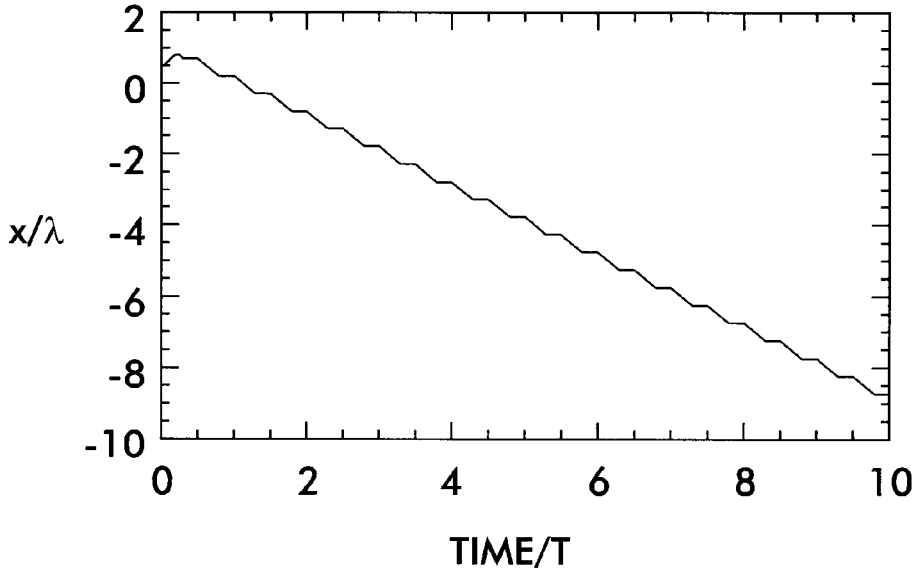

FIG. 6. The corresponding voltage pattern driving the electrodes of this grid during one period T The same vertical displacement of voltage profiles for different electrodes as in FIG. 2.

Again, simplistic considerations illustrated in FIG. 5 are confirmed by dynamic simulations. FIGS. 7A, 7B and FIGS. 8A, 8B show trajectories of a positive and a negative particle, respectively, induced by the waveform of FIG. 5. Evidently from FIGS. 7A, 7B and FIGS. 8A, 8B, particles of opposite signs indeed move in opposite directions in a hopping synchronous mode. The effect has been confirmed experimentally as well.

Figure 9:
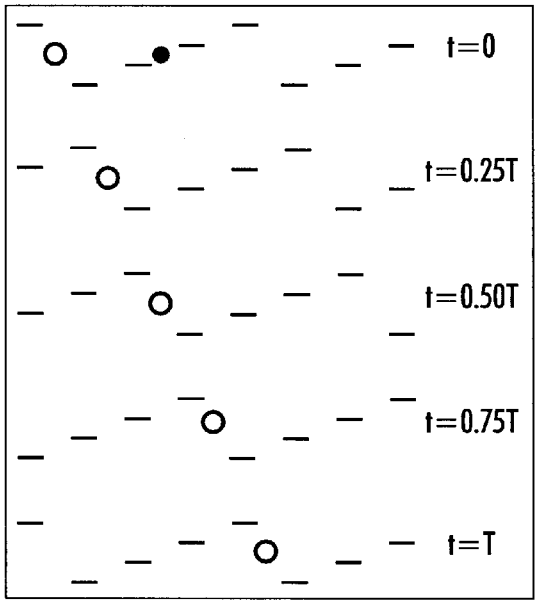

In the third example, we use such a waveform that produces a strongly asymmetric potential hill structure that regularly translates with time along the wave propagation. Therefore electric fields in one direction turn out to be much stronger than in the opposite direction (although on a larger scale). With asymmetry strong enough, the particles that would otherwise ride the less steeper side of the hill cannot catch the traveling wave and are repelled by the wave away from the carrying surface. They are then either lost to emissions or transported in the curtain mode with the velocity much lower than the wave phase velocity. The discussed waveforms can therefore provide transport in the unipolar synchronous mode, similarly to the situation discussed in the first example FIGS. 9 and 10 schematically show an example of such a waveform.

Figure 10:
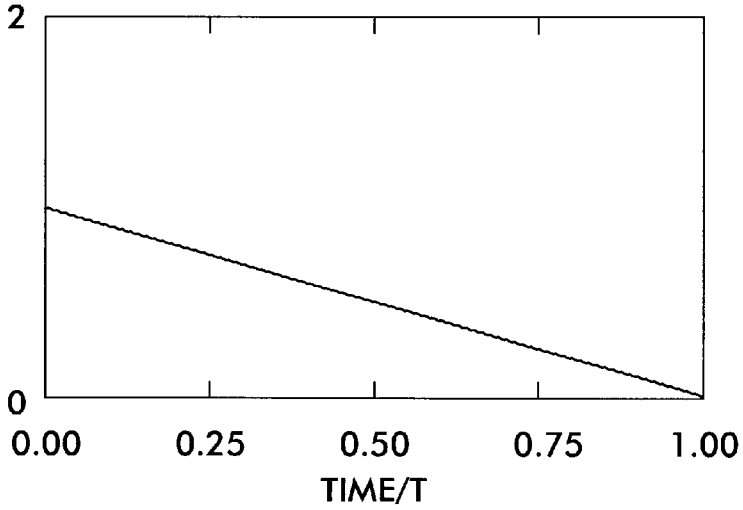

This waveform as seen by individual electrodes corresponds to the ramp-type driving voltage as shown in FIG. 10 (or its pulsed counterpart, and, of course, with appropriate phase shifts for different electrodes Evidently, the electric field moving a positive particle in this example is about three times stronger in this case than the field that would move a negative particle in the wave's direction. The negative particle is displayed as being lost while the positive particle moves with the wave phase velocity The results of dynamical simulations using this type of waveform for positive and negative particles are shown in FIGS. 11 and 12.

Figure 11A:
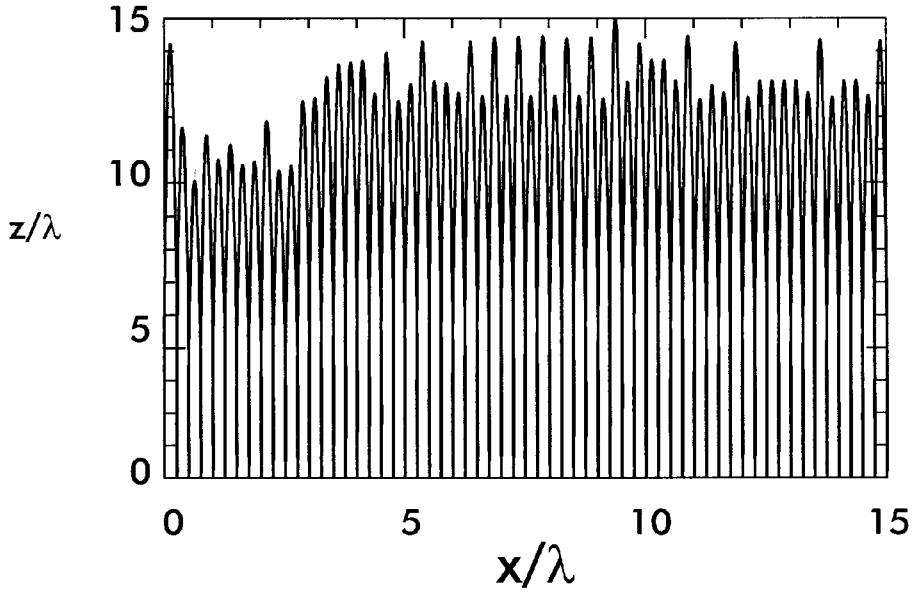
Figure 11B:
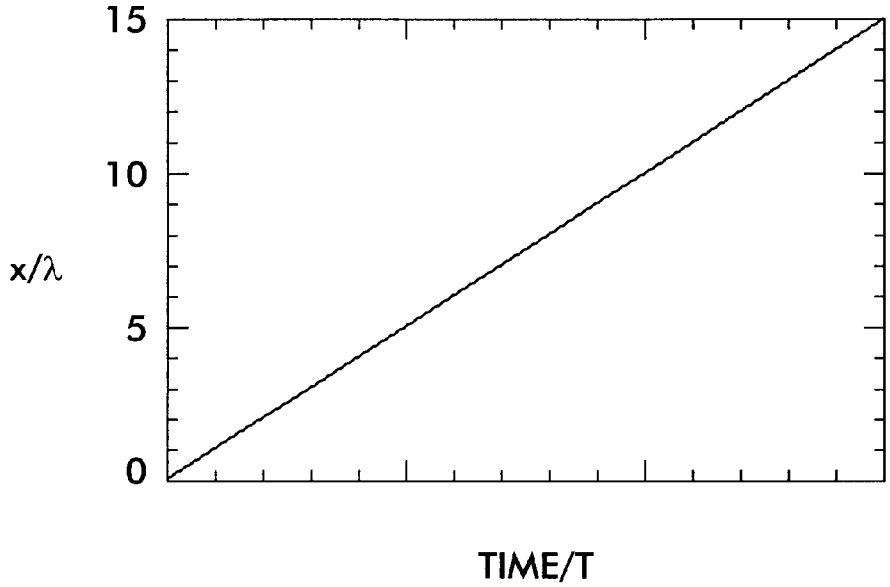
Figure 12A:
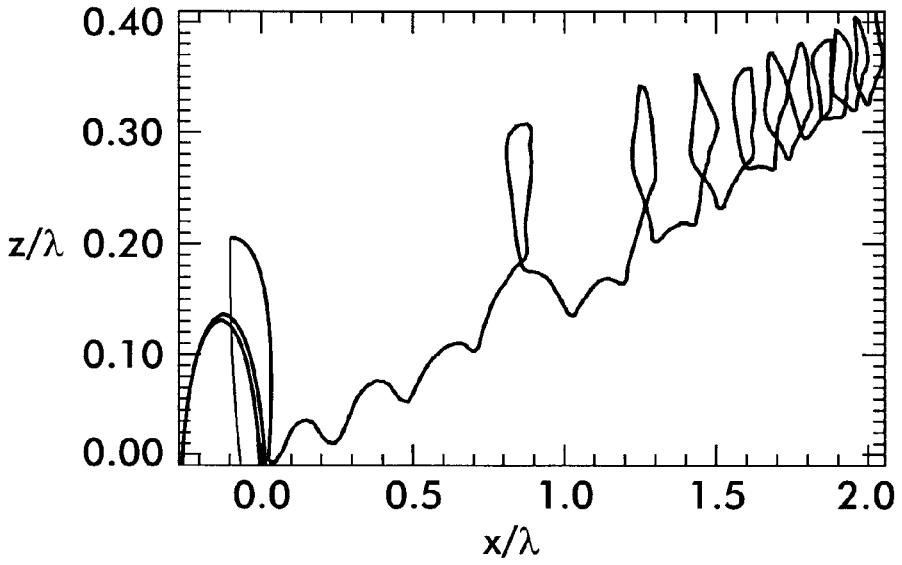
Figure 12B:
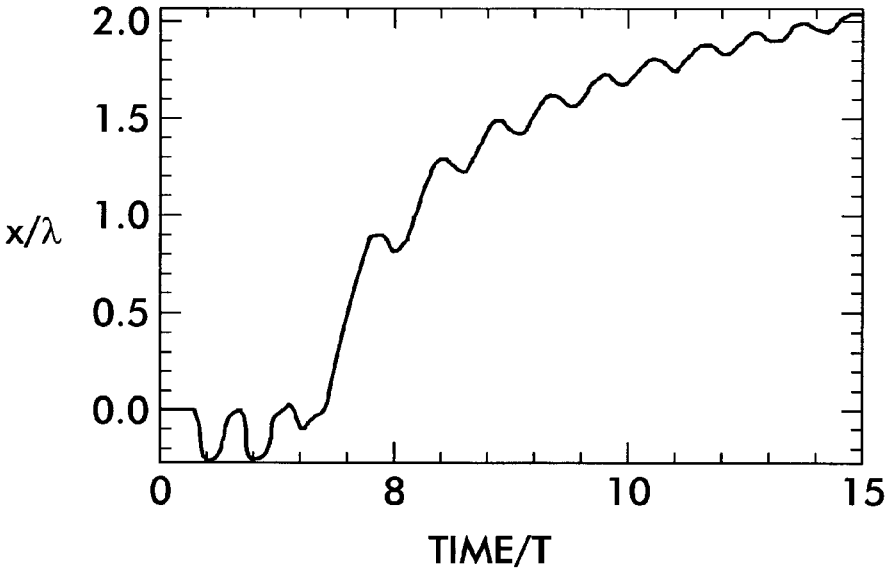

As seen in FIGS. 11A, 11B the electric field strength turns out to be sufficient to balance air drag and surface friction for the positive particle and it catches the wave. The electric field relevant for the negative particle is not high enough and the particle is repelled away from the surface to be lost by the wave, as displayed in FIGS. 12A and 12B.

The examples above have been intended to illustrate how the general principles of the present invention can be implemented. Evidently, many other implementations are possible that would use these general principles and also lead to different dynamic responses for oppositely charged particles. Other embodiments and modifications of the present invention may occur to those skilled in the art subsequent to a review of the information presented herein; these embodiments and modifications, as well as equivalents thereof, are also included within the scope of this invention.

What is claimed is:

1. An apparatus for developing a latent image recorded on an imaging surface, comprising:

a donor member, spaced from the imaging surface, for transporting toner on the surface thereof to a region opposed from the imaging surface, said donor member includes an electrode array on the outer surface thereof, said array including a plurality of spaced apart electrodes extending substantial across width of the surface of the donor member;

means for loading toner onto said donor member;

a multi-phase voltage source operatively coupled to said electrode array, said multiphase voltage source generating a waveform which creates an electrodynamic wave pattern for moving toner particles of one polarity to and from a development zone and preventing toner particles of the opposite polarity from moving to said development zone, said waveform generates a unipolar synchronous wave mode wherein toner particles of said first polarity are transported at a wave phase velocity of said waveform.

2. The apparatus of claim 1, wherein said wave form is a temporally waveform.

3. The apparatus of claim 1, wherein said wave form is a static asymmetry.

4. An apparatus for developing a latent image recorded on an imaging surface, comprising:

a donor member, spaced from the imaging surface, for transporting toner on the surface thereof to a region opposed from the imaging surface, said donor member includes an electrode array on the outer surface thereof, said array including a plurality of spaced apart electrodes extending substantial across width of the surface of the donor member;

means for loading toner onto said donor member;

a multi-phase voltage source operatively coupled to said electrode array, said multiphase voltage source generating a waveform which creates an electrodynamic wave pattern for moving toner particles of one polarity to and from a development zone and preventing toner particles of the opposite polarity from moving on to said development zone, said waveform generates an ambipolar bi-directional wave mode wherein toner particles of said first polarity and toner particles of the opposite polarity are transported in opposite directions from each other.

5. The apparatus of claim 4, wherein said wave form is a temporally waveform.

6. The apparatus of claim 4, wherein said wave form is a static asymmetry.

7. A method for transporting charge particles on a traveling wave grid comprising the steps of:

generating a waveform on said travel wave grid, which creates an electrodynamic wave pattern, said generating step includes forming an electric potential pattern whose one side essentially regularly translates with time, while the opposite side executes more complex movements;

moving particles of one polarity in a first direction with said electrodynamic wave pattern; and preventing particles of the opposite polarity from moving in said first direction with said electrodynamic wave pattern.

8. The method of claim 7, wherein said generating step includes regularly translating with time an asymmetric electric potential pattern.

* * * * *